US011350194B2

(12) United States Patent
Schepens

(10) Patent No.: US 11,350,194 B2
(45) Date of Patent: May 31, 2022

(54) LOUDSPEAKER

(71) Applicant: PSS BELGIUM NV, Dendermonde (BE)

(72) Inventor: Johan Schepens, Dendermonde (BE)

(73) Assignee: PSS BELGIUIM NV, Dendermonde (BE)

( * ) Notice: Subject to any disclaimer, the term of this patent is extended or adjusted under 35 U.S.C. 154(b) by 116 days.

(21) Appl. No.: 16/955,818

(22) PCT Filed: Dec. 7, 2018

(86) PCT No.: PCT/EP2018/084048
§ 371 (c)(1),
(2) Date: Jun. 19, 2020

(87) PCT Pub. No.: WO2019/121072
PCT Pub. Date: Jun. 27, 2019

(65) Prior Publication Data

US 2020/0344537 A1 Oct. 29, 2020

(30) Foreign Application Priority Data

Dec. 19, 2017 (GB) ..... 1721285

(51) Int. Cl.
*H04R 1/00* (2006.01)
*H04R 1/02* (2006.01)
*H04R 9/02* (2006.01)

(52) U.S. Cl.
CPC ..... *H04R 1/023* (2013.01); *H04R 9/025* (2013.01)

(58) Field of Classification Search
CPC ..... H04R 1/2834; H04R 9/063; H04R 1/02; H04R 1/24
See application file for complete search history.

(56) References Cited

U.S. PATENT DOCUMENTS 5,081,684 A 1/1992 House
2007/0036382 A1* 2/2007 Gladwin ..... H04R 7/26 381/337

FOREIGN PATENT DOCUMENTS

CN 203596914 U 5/2014
JP S60229500 A 11/1985
(Continued)

OTHER PUBLICATIONS

PCT, International Search Report in International application No. PCT/EP2018/084048 dated Feb. 15, 2019.
(Continued)

*Primary Examiner* — Amir H Etesam
(74) *Attorney, Agent, or Firm* — NK Patent Law

(57) ABSTRACT

A loudspeaker including a diaphragm having a front surface facing in a forward direction for producing sound to be radiated outwardly from the loudspeaker in the forward direction and a back surface facing in a backward direction that is opposite to the forward direction; a magnet unit configured to provide magnetic field in a predetermined region of space; a voice coil rigidly connected to the diaphragm, wherein the voice coil is configured to produce a magnetic field in use which interacts with the magnetic field provided by the magnet unit in the predetermined region of space so as to move the diaphragm along a longitudinal axis of the loudspeaker; a flexible dustcap attached to the diaphragm and an attachment surface of the loudspeaker that is fixed with respect to the magnet unit and is located radially inwards of the voice coil relative to the longitudinal axis of the loudspeaker.

20 Claims, 6 Drawing Sheets

(56) References Cited

FOREIGN PATENT DOCUMENTS

| | | | |
|---|---|---|---|
| JP | S61121692 | A | 6/1986 |
| JP | H1013993 | A | 1/1998 |
| JP | H1146395 | A | 2/1999 |
| WO | 2017045795 | A1 | 3/2017 |

OTHER PUBLICATIONS

PCT, Written Opinion in International application No. PCT/EP2018/084048 dated Feb. 15, 2019.
CNIPA, Office Action in Chinese Application No. 2018800828085 dated Nov. 3, 2020.

* cited by examiner

LOUDSPEAKER

CROSS REFERENCE TO RELATED APPLICATIONS

This application is a U.S. National Stage application of International Patent Application No. PCT/EP2018/084048 filed on 7 Dec. 2018, which claims priority from GB1721285.3 filed 19 Dec. 2017, the contents and elements of which are herein incorporated by reference for all purposes.

FIELD OF THE INVENTION

The present invention relates to a loudspeaker.

BACKGROUND

The present inventor has observed that in most loudspeakers that incorporate a dustcap, the dustcap is typically a rigid element attached to a front surface of a diaphragm, which extends across and covers a hole in the diaphragm. Such a hole may for example be present in the diaphragm to accommodate a magnet unit (as shown in FIG. 1) or to allow the diaphragm to be more easily attached to a voice coil former (as shown e.g. in FIG. 1 of WO2017/045795 A1).

A typical purpose of a dustcap is for preventing dust, moisture or other foreign particles from getting into a magnet unit via an air gap in which a magnetic field is provided by the air gap. A dustcap may also help to protect a listener from any unwanted noise (typically high frequency noise) generated behind the diaphragm of the loudspeaker.

A dustcap in the form of a rigid element attached to a front surface of a diaphragm, which extends across and covers a hole in the diaphragm (e.g. as illustrated below with reference to FIG. 1, or in FIG. 1 of WO2017/045795 A1) works well in many situations.

However, the present inventor has observed that in some contexts, e.g. when designing a low-profile loudspeaker (i.e. a loudspeaker designed to have a small height as measured along a longitudinal axis along which the diaphragm is moved), a rigid dustcap can increase the height of the loudspeaker when the diaphragm is at its maximum extent in the forward direction. These issues are described in more detail below with reference to FIGS. 1 and 2 of the present application. In view of these considerations, the present inventor therefore felt that it would be desirable to seek a way to reduce the impact of the dustcap on height of a loudspeaker, particularly when the diaphragm of the loudspeaker is at its maximum extent in the forward direction.

An example drive unit arrangement for incorporation a low-profile loudspeaker is shown in U.S. Pat. No. 5,081,684. In this arrangement, a voice coil is rigidly connected to the diaphragm via a rigid connector, which include ribs which extend through slits in a magnet unit. Other techniques for achieving a low-profile loudspeaker are known.

The present invention has been devised in light of the above considerations.

SUMMARY OF THE INVENTION

In a first aspect, the present invention may provide:

A loudspeaker including:

a diaphragm having a front surface facing in a forward direction for producing sound to be radiated outwardly from the loudspeaker in the forward direction and a back surface facing in a backward direction that is opposite to the forward direction;

a magnet unit configured to provide magnetic field in a predetermined region of space;

a voice coil rigidly connected to the diaphragm, wherein the voice coil is configured to produce a magnetic field in use which interacts with the magnetic field provided by the magnet unit in the predetermined region of space so as to move the diaphragm along a longitudinal axis of the loudspeaker;

a flexible dustcap attached to the diaphragm and an attachment surface of the loudspeaker that is fixed with respect to the magnet unit and is located radially inwards of the voice coil relative to the longitudinal axis of the loudspeaker.

By using a flexible dustcap as described above, the present inventor has found that the height of a loudspeaker with the diaphragm at its maximum extent in the forward direction can be reduced compared with a situation in which a more conventional rigid dustcap is used.

Preferably, the flexible dustcap includes more than one corrugation.

The present inventor has found that a loudspeaker with reduced height can most effectively be achieved if there is more than one corrugation in the flexible dustcap.

For the purposes of this disclosure, the term "corrugation" being used with respect to an element can be understood as a ridge or a furrow formed in the element. Each corrugation (e.g. ridge or furrow) included in the flexible dustcap may extend around the longitudinal axis of the loudspeaker, e.g. in a circumferential direction with respect to the longitudinal axis of the loudspeaker.

The longitudinal axis may extend through a central region of the loudspeaker, preferably through a centre of the voice coil. If the diaphragm is rotationally symmetric, the longitudinal axis may pass through the rotational axis of symmetry of the diaphragm.

The diaphragm may be configured to be moved along the longitudinal axis from a nominal position (e.g. a rest position, which may be the position the diaphragm is in when the voice coil does not have a current passing through it) up to a maximum extent in the forward direction and a maximum extent in the backward direction.

The flexible dustcap is preferably configured to allow the diaphragm to be moved along the longitudinal axis from a nominal position up to a maximum extent in the forward direction and a maximum extent in the backward direction without the flexible dustcap contacting the magnet unit or the voice coil in use.

The predetermined region of space (in which the magnet unit is configured to provide magnetic field) may be an air gap located between two components of the magnet unit. One of the two components may be located radially inwards of the voice coil relative to the longitudinal axis of the loudspeaker, with the other of the two components being located radially outwards of the voice coil of the magnet unit. One or both of the two components may be a permanent magnet. One or both of the two components may be a magnetic field guiding element, e.g. of steel. The magnetic field guiding element(s) may act to guide a magnetic field produced by a permanent magnet included in the magnet unit (the permanent magnet may be, but need not be, one of the two components). Preferably, the component located radially inwards of the voice coil is a permanent magnet. Preferably the component located radially outwards of the voice coil is a magnetic field guiding element, since magnetic field guiding elements can in general be made thinner than a permanent magnet, which may help to simplify the design of the loudspeaker.

The voice coil may be configured to produce a magnetic field when an electric current is passed through it in use, wherein the magnetic field produced by the voice coil interacts with the magnetic field provided by the magnet unit in the predetermined region of space so as to move the diaphragm forwards and backwards along a longitudinal axis of the loudspeaker. The electric current passed through the voice coil may be configured to move the voice coil in a predetermined frequency range, e.g. a bass frequency range.

The voice coil may be rigidly connected to the diaphragm via a rigid connector. The rigid connector may e.g. be attached to the voice coil and the diaphragm.

In some examples, the rigid connector may include ribs which extend through slits in the component located radially outwards of the voice coil (of the two components between which the air gap is located). The slits may extending in the direction of the longitudinal axis. There may be three or more ribs, and three or more slits, e.g. where each rib extends through a respective slit. Such an arrangement may be based on principles described e.g. in U.S. Pat. No. 5,081,684.

In some examples, the rigid connector may be a voice coil former. The voice coil former may be a tube on which the voice coil is mounted.

The flexible dustcap is preferably configured to prevent dust (or other foreign particles) from entering into the predetermined region of space (e.g. air gap).

The diaphragm may include a hole, e.g. to accommodate a magnet unit (as shown in FIG. 5) or to allow the diaphragm to be more easily attached to the voice coil, e.g. via a rigid connector such as a voice coil former.

The loudspeaker may include a frame. The magnet unit may be attached to the frame (directly or indirectly) such that the magnet unit is fixed with respect to the frame. The diaphragm may be suspended from the frame via one or more suspension elements. The one or more suspension elements may include a roll suspension (e.g. a half-roll edge suspension) which extends (preferably continuously) around an outer edge of the diaphragm. The one or more suspension elements may include a spider which connects to the diaphragm (directly, or via another element such as a rigid connector) at a region of the diaphragm that is radially inwards of the outer edge of the diaphragm with respect to the longitudinal axis of the loudspeaker. A spider is typically a ring of textile material.

The loudspeaker may be a low-profile loudspeaker, e.g. having a height in the direction of the longitudinal axis of the loudspeaker from a forward-most surface to a backward-most surface of the loudspeaker when the diaphragm is at its maximum extent in the forward direction of 90 mm or less, more preferably 75 mm or less, more preferably 65 mm or less. Such a height may be achievable even if the distance in the direction of the longitudinal axis through between the maximum extent in the forward direction and the maximum extent in the backward direction of the diaphragm (referred to as "peak to peak excursion distance", below) is 20 mm or more, 30 mm or more, or even 40 mm or more.

These figures are achievable since using a flexible dustcap as disclosed herein, the present inventor was able to make a loudspeaker having a height of ~65 mm with a peak to peak excursion of ~40 mm.

Herein, a reference to a distance in the direction of the longitudinal axis between two different positions of the diaphragm may be understood as referring to the minimum distance in the direction of the longitudinal axis through which the diaphragm must be moved in order to get from one position to the other.

The attachment surface of the loudspeaker that is fixed with respect to the magnet unit may be a surface of the magnet unit, or a surface on a frame of the loudspeaker that is fixed with respect to the magnet unit. In some examples, the attachment surface may be a front surface of the magnet unit, which faces in the forward direction.

For avoidance of any doubt, the flexible dustcap could, for example, attach to the front surface or the back surface of the diaphragm (or even a side surface of the diaphragm). The flexible dustcap could potentially attach to the diaphragm indirectly, e.g. via an intermediate element, through the flexible dustcap preferably attaches directly to the diaphragm.

Some optional features of the flexible dustcap will now be described, which may be described with reference to the diaphragm being in its nominal position (since other positions of the diaphragm may cause the flexible dustcap to deform).

The flexible dustcap may (e.g. when the diaphragm is in its nominal position) include an upstanding portion which extends around the longitudinal axis of the loudspeaker (e.g. in a circumferential direction with respect to the longitudinal axis) and which, when viewed in a cross-section taken along the longitudinal axis of the loudspeaker, extends in the forwards direction from the attachment surface of the loudspeaker, preferably at an angle that is no more than 30°, more preferably an angle that is no more than 20°, with respect to the longitudinal axis of the loudspeaker. The upstanding portion may attach to the attachment surface of the loudspeaker, directly or indirectly, e.g. via an (optional) inner attachment portion of the flexible dustcap.

The flexible dustcap may (e.g. when the diaphragm is in its nominal position) include an outwardly extending portion which extends around the longitudinal axis of the loudspeaker (e.g. in a circumferential direction with respect to the longitudinal axis) and which, when viewed in a cross-section taken along the longitudinal axis of the loudspeaker, extends radially outwards from the upstanding portion relative to the longitudinal axis of the loudspeaker. The outwardly extending portion may, when viewed in a cross-section taken along the longitudinal axis of the loudspeaker, form an angle that is no more than 20° with respect to a radial axis that extends radially outwardly from and is perpendicular to the longitudinal axis of the loudspeaker.

The upstanding portion may (e.g. when the diaphragm is in its nominal position) be joined to the outwardly extending portion by a bend in the flexible dustcap, wherein the bend extends around the longitudinal axis of the loudspeaker (e.g. in a circumferential direction with respect to the longitudinal axis). The first bend, when viewed in a cross-section taken along the longitudinal axis of the loudspeaker, preferably has a smoothly changing curvature, rather than being a sharp fold or corner in the flexible dustcap.

The flexible dustcap may (e.g. when the diaphragm is in its nominal position) include a first corrugation which extends around the longitudinal axis of the loudspeaker (e.g. in a circumferential direction with respect to the longitudinal axis). The first corrugation, when viewed in a cross-section taken along the longitudinal axis of the loudspeaker, may form a ridge or furrow in the flexible dustcap (depending on how it is oriented). The first corrugation may, when viewed in a cross-section taken along the longitudinal axis of the loudspeaker, include two arms which join at a base, e.g. to form a "U" shape or a "V" shape (preferably a "U" shape). Preferably the first corrugation is oriented with its base facing in the backward direction. One arm (preferably the radially innermost arm) of the first corrugation may be joined to the outwardly extending portion, preferably via a non-smoothly changing fold (e.g. a sharp fold or corner) in the flexible dustcap.

The flexible dustcap may (e.g. when the diaphragm is in its nominal position) include a second corrugation which extends around the longitudinal axis of the loudspeaker (e.g. in a circumferential direction with respect to the longitudinal axis). The second corrugation, when viewed in a cross-section taken along the longitudinal axis of the loudspeaker, may form a ridge or furrow in the flexible dustcap (depending on how it is oriented). The second corrugation may, when viewed in a cross-section taken along the longitudinal axis of the loudspeaker, include two arms which join at a base, e.g. to form a "U" shape or a "V" shape (preferably a "U" shape). Preferably the second corrugation is oriented with its base facing in the forward direction. One arm (preferably the radially innermost arm) of the second corrugation may also be an arm (preferably the radially outermost arm) of the first corrugation. One arm (preferably the radially outermost arm) of the second corrugation may attach to the diaphragm, e.g. a front or back surface of the diaphragm, e.g. directly, or via an (optional) outer attachment portion of the flexible dustcap.

The flexible dustcap may (e.g. when the diaphragm is in its nominal position) extend in the direction of the longitudinal axis by a distance (G) above a forward-most location on the voice coil when the diaphragm is at its maximum extent in the forward direction. G is preferably 20 mm or less, more preferably 10 mm or less, more preferably 8 mm or less, more preferably 5 mm or less, more preferably 4 mm or less, more preferably 3 mm or less, more preferably 2 mm or less, more preferably 1 mm or less.

The flexible dustcap may be a single piece of flexible material, e.g. rubber or textile (with or without coating), or may be made of multiple materials attached to each other (a single piece of flexible material is preferred).

The thicknesses and/or materials of different portions of the flexible dustcap may be different to each other so that a desired level of flexibility/stiffness is achieved in each of the different portions.

For example, the upstanding portion may be stiffer than (e.g. by being thicker than) the bend and/or the outwardly extending portion.

For example, the bend may be stiffer than (e.g. by being thicker than) the outwardly extending portion.

For example, the outwardly extending portion may be stiffer than (e.g. by being thicker than) the first and/or second corrugations (in some examples the first and second corrugations may have the same thickness as each other).

The loudspeaker may be a subwoofer. A subwoofer is a loudspeaker dedicated to producing bass frequencies, typically under 250 Hz, more typically under 200 Hz.

The loudspeaker may be used in cars or home entertainment systems, e.g. HiFi loudspeakers, for example.

In a second aspect, the present invention may provide: A flexible dustcap as described herein. The flexible dustcap may be a flexible dustcap as described in connection with the first aspect of the invention, but any other features of a loudspeaker according to the first aspect of the invention being required.

The invention includes the combination of the aspects and preferred features described except where such a combination is clearly impermissible or expressly avoided.

SUMMARY OF THE FIGURES

Embodiments and experiments illustrating the principles of the invention will now be discussed with reference to the accompanying figures in which.

DETAILED DESCRIPTION OF THE INVENTION

Aspects and embodiments of the present invention will now be discussed with reference to the accompanying figures. Further aspects and embodiments will be apparent to those skilled in the art. All documents mentioned in this text are incorporated herein by reference.

Figure 1:
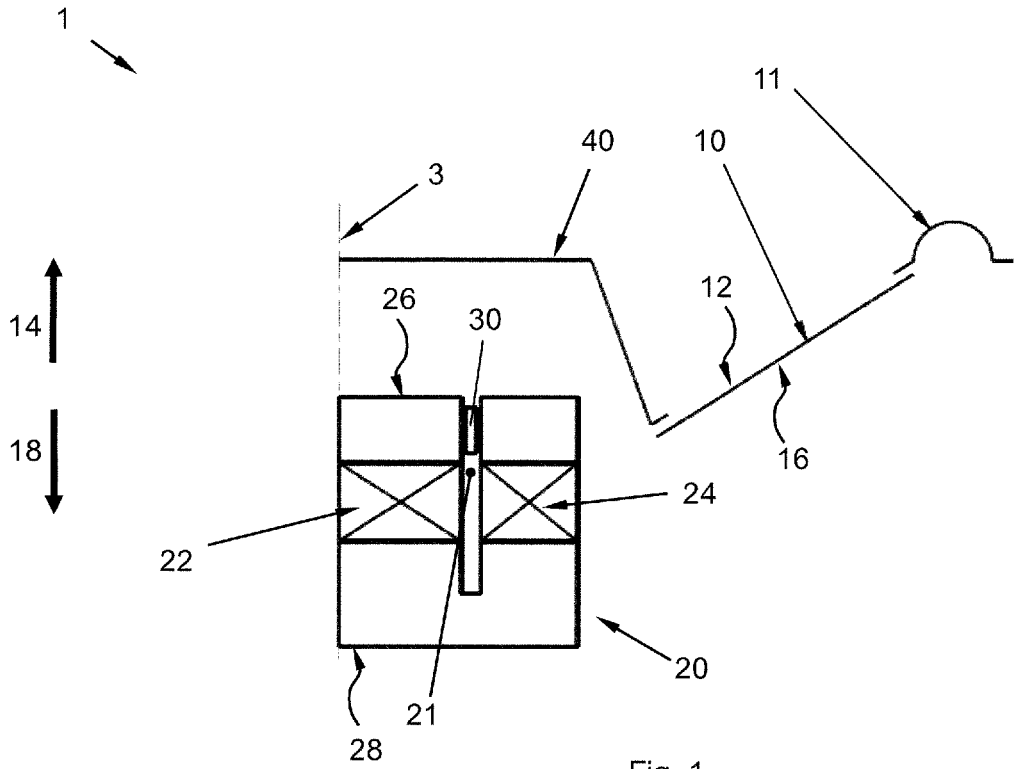
FIG. 1 illustrates a loudspeaker 1 designed by the inventors according to known principles.

FIG. 1 illustrates a loudspeaker 1 designed by the inventors according to known principles. The loudspeaker 1 has a diaphragm 10 having a front surface 12 facing in a forward direction 14 for producing sound to be radiated outwardly from the loudspeaker 1 in the forward direction 14 and a back surface 16 facing in a backward direction 18. In this example, the forward direction 14 is opposite to the backward direction 18, and both the forward and backward directions 14, 18 extend along the longitudinal axis 3. In this example, the diaphragm 10 is circular, though other shapes could be envisaged.

The diaphragm 10 is suspended from a frame of the loudspeaker (not shown in FIG. 1) by a roll suspension 11 (in this example a half-roll edge suspension) which is attached to an outer edge of the diaphragm 10, e.g. by glue, and which extends continuously around the outer edge of the diaphragm 10. For completeness, we note that the attachment between the outer edge of the diaphragm 10 and the roll suspension 11 is illustrated in FIG. 1, but not in subsequent figures.

The loudspeaker 1 also includes an electromagnetic drive unit that includes a magnet unit 20 and a voice coil 30.

The magnet unit 20 is configured to provide magnetic field in an air gap 21 located between two components 22, 24 of the magnet unit 20. In this example, the component 22 is a permanent magnet and the component 24 is a magnetic field guiding element. However, a skilled person would appreciate that the component 22 could be a permanent magnet or a magnetic field guiding element, and the component 24 could be a permanent magnet or a magnetic field guiding element.

The voice coil 30 is rigidly connected to the diaphragm 10. The voice coil 30 is configured to produce a magnetic field in use (by passing a current through it) which interacts with the magnetic field provided by the magnet unit 20 in the air gap 21 so as to move the diaphragm 10 along a longitudinal axis 3 of the loudspeaker 1.

In this example, the voice coil 30 is rigidly connected to the diaphragm 10 via a rigid connector (not shown), which include ribs which extend through slits in the magnetic field guiding element 24. A similar arrangement is employed in the loudspeaker 301 shown in FIG. 10, for example. This arrangement, which involves using a rigid connector 32 to rigidly connect the voice coil 30 to the diaphragm 10 via slits in the magnetic field guiding element 24 is based on principles described e.g. in U.S. Pat. No. 5,081,684. Such an arrangement, particularly when combined with a diaphragm having a relatively flat shape, allows for a loudspeaker having a reduced height.

The diaphragm 10 has a hole at its centre to accommodate a magnet unit 20 (described below), thereby allowing for a loudspeaker of reduced height. A rigid dustcap 40, attached to the front surface 12 of the diaphragm 10 (e.g. by glue), extends across and covers the hole in the middle of the diaphragm 10, so as to prevent dust from getting into the magnet unit 20 via an air gap 21 (described below).

Figure 2:
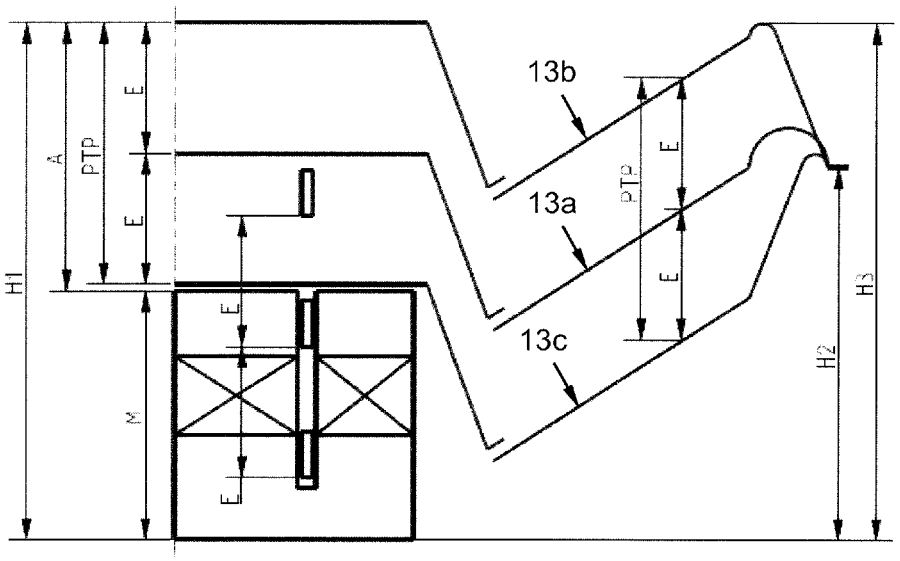
FIG. 2 shows the diaphragm 10 of the loudspeaker 1 of FIG. 1 in each of a nominal position, a maximum extent in a forward direction 14, and a maximum extent in a backward direction 18.

FIG. 2 shows the diaphragm 10 of the loudspeaker 1 of FIG. 1 in each of a nominal position as indicated by numeral 13*a* (this is a rest position, which is the position the diaphragm 10 is in when the voice coil 30 does not have a current passing through it), a maximum extent in the forward direction 14 as indicated by numeral 13*b* and a maximum extent in the backward direction 18 as indicated by numeral 13*c*. The positions of the dustcap 40, the voice coil 30, and the roll suspension 11 when the diaphragm is in each of the three positions are also shown in FIG. 2.

The following distances are also labelled in FIG. 2:

E: excursion distance, this being the distance in the direction of the longitudinal axis 3 between the nominal position (as indicated by numeral 13*a*) and each of the maximum extent in the forward direction 14 (as indicated by numeral 13*b*) and the maximum extent in the backward direction 18 (as indicated by numeral 13*c*) of the diaphragm 10.

PTP: peak to peak excursion distance, this being the distance in the direction of the longitudinal axis 3 between the maximum extent in the forward direction 14 and the maximum extent in the backward direction 18 of the diaphragm 10 (this being twice the excursion distance E)

A: distance in the direction of the longitudinal axis 3 between a front surface 26 of the magnet unit 20 (which faces in the forward direction 14) and a forward-most location on the dustcap 40 when the diaphragm 10 is at its maximum extent in the forward direction 14

H1: distance in the direction of the longitudinal axis 3 between the forward-most location on the dustcap 40 when the diaphragm 10 is at its maximum extent in the forward direction 14 and a rear surface 28 of the magnet unit 20 (which faces in the backward direction 18)

H2: distance in the direction of the longitudinal axis 3 between a point on the frame from which the diaphragm 10 is suspended and the rear surface 28 of the magnet unit 20

H3: distance in the direction of the longitudinal axis 3 between a forward-most location on the roll suspension 11 when the diaphragm 10 is at its maximum extent in the forward direction 14 and the rear surface 28 of the magnet unit 20

M ("magnet unit height"): distance in the direction of the longitudinal axis 3 between the front surface 26 and the rear surface 28 of the magnet unit 20

The rigid dustcap 40 is, as is the case with conventional dustcaps, designed to be stiff, i.e. so that it does not bend (or bends very little) during operation of the loudspeaker 1. The rigid dustcap therefore moves up and down with the diaphragm by the excursion distance E and with a peak to peak excursion distance PTP of 2×E.

As illustrated by FIG. 2, since the rigid dustcap 40 is positioned in front of the magnet unit 20, the total speaker height H1 during operation will be basically be H1=M+A, where A equates to the height of a forward-most location on the rigid dustcap 40 above the front surface of the magnet unit 20 when the diaphragm 10 is at its maximum extent in the forward direction 14. The height A is basically the same as the distance PTP (2×E) with the thickness of the rigid dustcap 40 at the voice coil 30 and small clearance added so that the rigid dustcap 40 does not contact the magnet unit 20 when the diaphragm 10 is at its maximum extent in the backward direction 18.

The present inventor has observed that reducing the outer heights H2, H3 (e.g. by using a diaphragm 10 having a flatter shape and mounting the diaphragm 10 at a lower point on the frame of the loudspeaker 1) does not reduce the speaker height when the diaphragm 10 is at its maximum extent in the forward direction 14, since H1 would still be defining the speaker height in this context.

In other words, the present inventor has observed that a rigid dustcap, such as the rigid dustcap 40, can limit the amount by which the height of a loudspeaker can be reduced when the loudspeaker is in use.

Figure 3:
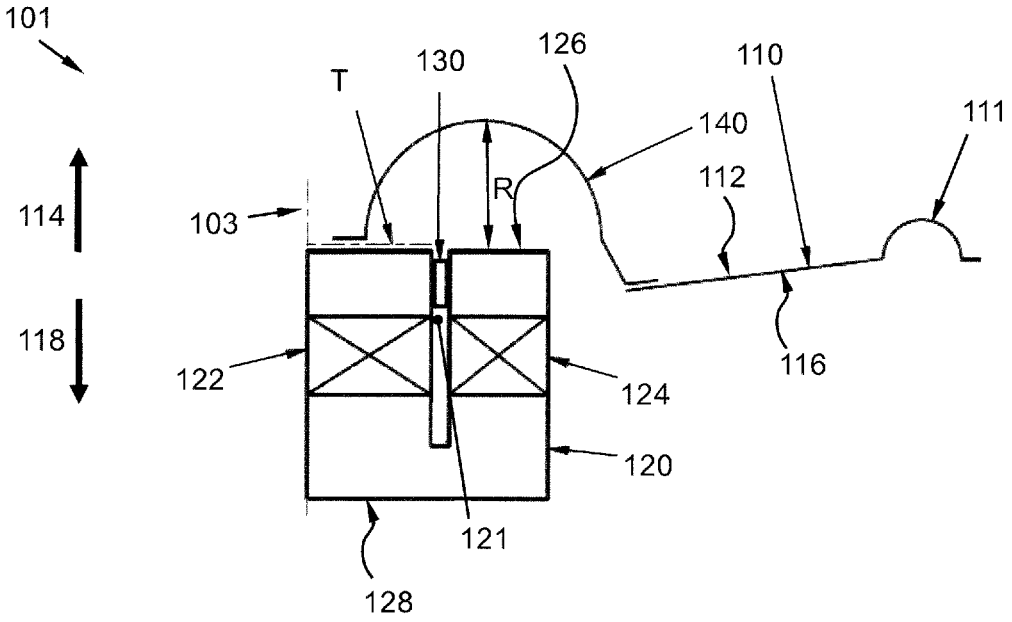
FIG. 3 illustrates a loudspeaker 101 designed by the inventors which includes a flexible dustcap 140.

FIG. 3 illustrates a loudspeaker 101 designed by the inventors which includes a flexible dustcap 140.

The loudspeaker 101 of FIG. 3 is similar to the loudspeaker 1 of FIG. 1 in several respects, and alike components have been given corresponding reference numerals and need not be explained in further detail, except where an alternative explanation is provided below.

In the loudspeaker 101 of FIG. 3, the rigid dustcap 40 of FIG. 1 has been replaced with a flexible dustcap 140. In this example, the flexible dustcap 140 takes the form of a classic half roll edge suspension which is attached to the front surface 112 of the diaphragm 110 and an attachment surface T on the front surface 126 of the magnet unit, which faces in the forward direction 114.

Figure 4:
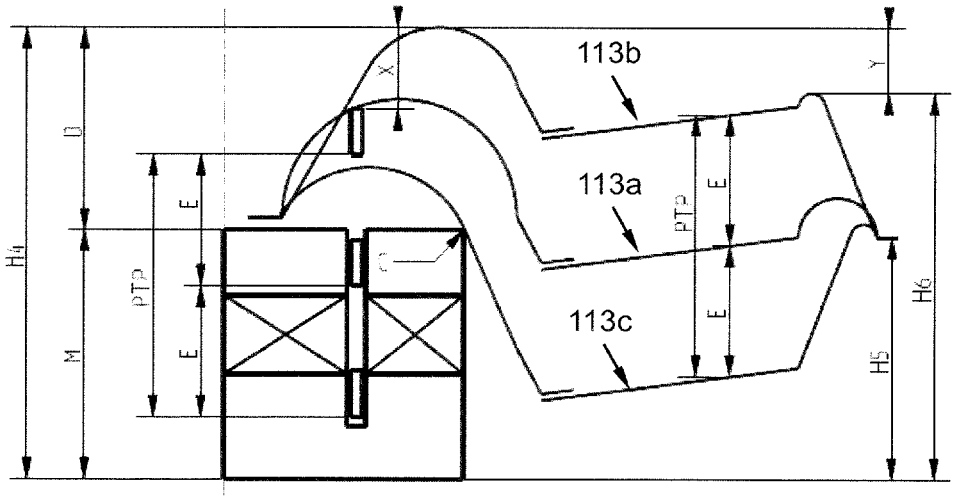
FIG. 4 shows the diaphragm 110 of the loudspeaker 101 of FIG. 3 in each of a nominal position, a maximum extent in a forward direction 114, and a maximum extent in a backward direction 118.

FIG. 4 shows the diaphragm 110 of the loudspeaker 101 of FIG. 1 in each of a nominal position as indicated by numeral 113*a* (this is a rest position, which is the position the diaphragm 110 is in when the voice coil 130 does not have a current passing through it), a maximum extent in the forward direction 114 as indicated by numeral 113*b* and a maximum extent in the backward direction 118 as indicated by numeral 113*c*. The positions of the dustcap 140, the voice coil 130, and the roll suspension 111 when the diaphragm is in each of the three positions are also shown in FIG. 4.

The following distances are also labelled in FIG. 4:

E: excursion distance, this being the distance in the direction of the longitudinal axis 103 between the nominal position (indicated by numeral 113*a*) and each of the maximum extent in the forward direction 114 (as indicated by numeral 113*b*) and the maximum extent in the backward direction 118 (as indicated by numeral 113*c*) of the diaphragm 110.

PTP: peak to peak excursion distance, this being the distance in the direction of the longitudinal axis 103 between the maximum extent in the forward direction 114 and the maximum extent in the backward direction 118 of the diaphragm 110 (this being twice the excursion distance E)

D: distance in the direction of the longitudinal axis 103 between the front surface 126 of the magnet unit 120 and a forward-most location on the flexible dustcap 140 when the diaphragm 110 is at its maximum extent in the forward direction 114

H4: distance in the direction of the longitudinal axis 103 between the forward-most location on the flexible dustcap 140 when the diaphragm 110 is at its maximum extent in the forward direction 114 and the rear surface 128 of the magnet unit 120

H5: distance in the direction of the longitudinal axis 103 between a point on the frame from which the diaphragm 110 is suspended and the rear surface 128 of the magnet unit 120

H6: distance in the direction of the longitudinal axis 103 between a forward-most location on the roll suspension 111 when the diaphragm 110 is at its maximum extent in the forward direction 114 and the rear surface 128 of the magnet unit 120

M: distance in the direction of the longitudinal axis 103 between the front surface 126 and the rear surface 128 of the magnet unit 120

X: distance in the direction of the longitudinal axis 103 between a forward-most location on the voice coil 130 when the diaphragm 110 is at its maximum extent in the forward direction 114 and a forward-most location on the flexible dustcap 140 when the diaphragm 110 is at its maximum extent in the forward direction 114

Y: distance in the direction of the longitudinal axis 103 between a forward-most location on the roll suspension 111 when the diaphragm 110 is at its maximum extent in the forward direction 114 and a forward-most location on the flexible dustcap 140 when the diaphragm 110 is at its maximum extent in the forward direction 114

The radius of curvature R of the half roll edge suspension provided by the flexible dustcap 140 is defined based on a preferred requirement for the flexible dustcap 140 to pass over the voice coil 130 when the diaphragm 110 is at its maximum extent in the forward direction 114, and a preferred requirement for the flexible dustcap 140 to pass over without contacting the corner C of the magnet unit 120 when the diaphragm 110 is at its maximum extent in the backward direction 118. This corner C could be chamfered or rounded to help meet the second of these preferred requirements.

Figure 9:
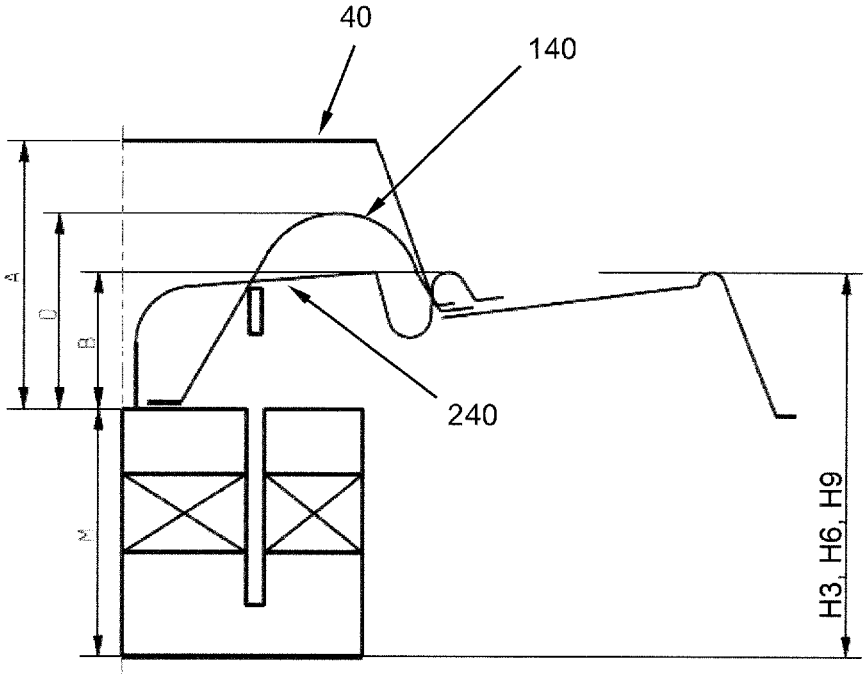
FIG. 9 provides a comparison between the heights of the dustcaps of the loudspeakers 1, 101, 201 of FIGS. 1, 3 and 5 above the front surface of the magnet unit when the diaphragm is at its maximum extent in the forward direction.

Thus, the radius of curvature R of the half roll edge suspension provided by the flexible dustcap 140 is preferably big with a result that the height D of a forward-most location on the flexible dustcap 140 above the front surface of the magnet unit 120 when the diaphragm 110 is at its maximum extent in the forward direction 14, will still be around 1.5×the excursion E, which is still a considerable height, though less than the corresponding height A of the rigid dustcap 40 (see e.g. FIG. 9, which is explained in more detail below).

For loudspeakers with E=20 mm, this still gives a height D of ~30 mm.

From FIG. 4, the distance X can be seen to be much more than the thickness of the dustcap 140.

The present inventor has observed that reducing the outer height H6 does not reduce the maximum speaker height when the diaphragm is at its maximum extent in the forward direction (as indicated by numeral 13*b*), since H4 would still be defining the speaker height in this context.

A key point to note from FIG. 4 is that replacing a rigid dustcap 40 with a flexible dustcap 140 helps to reduce the height of the loudspeaker when the diaphragm is at its maximum extent in the forward direction by some extent (about 0.5×E).

Figure 5:
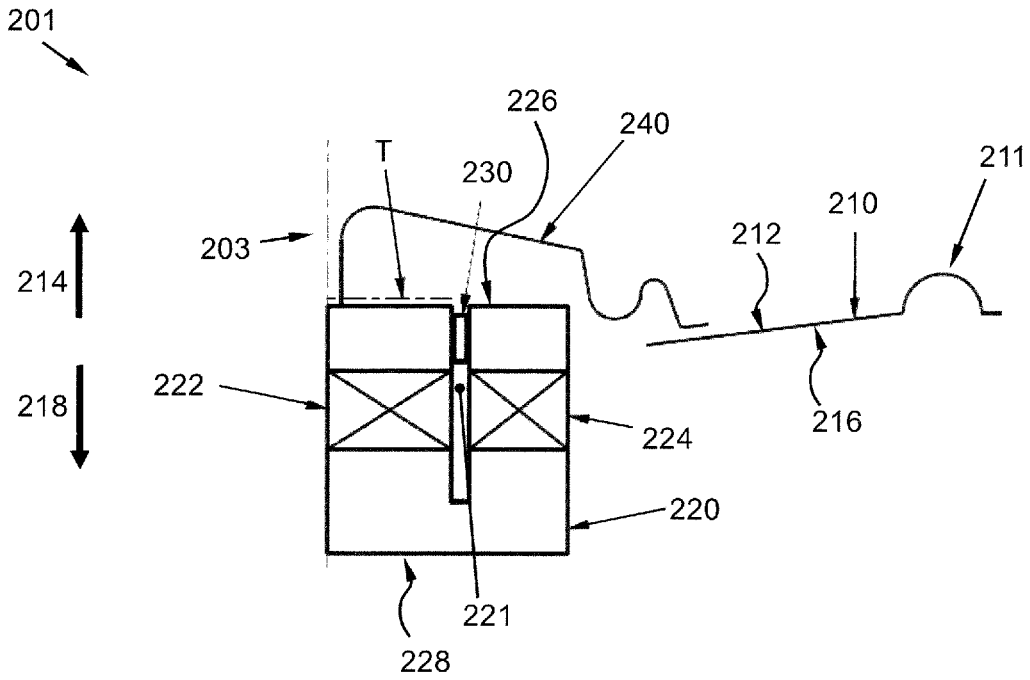
FIG. 5 illustrates a loudspeaker 201 designed by the inventors which includes a flexible dustcap 240.

FIG. 5 illustrates a loudspeaker 201 designed by the inventors which includes a flexible dustcap 240.

The loudspeaker 201 of FIG. 5 is similar to the loudspeaker 101 of FIG. 3 in several respects, and alike components have been given corresponding reference numerals and need not be explained in further detail, except where an alternative explanation is provided below.

In the loudspeaker 201 of FIG. 5, the flexible dustcap 140 of FIG. 3 has been replaced with a different flexible dustcap 240 that includes multiple corrugations.

As with the loudspeaker 101 of FIG. 3, in the loudspeaker 201 the flexible dustcap 240 is attached (in this example) to the front surface 212 of the diaphragm 210 and an attachment surface T, the attachment surface T being (in this example) on the front surface 226 of the magnet unit 220. In other examples (not shown), the flexible dustcap 240 could be attached instead to the back surface 216 of the diaphragm 210 and/or an alternative attachment surface elsewhere in the loudspeaker 201 that is fixed with respect to the magnet unit 220.

Note that since the attachment surface T is on the front surface 226 of the magnet unit 220, it is fixed with respect to the magnet unit 220. The attachment surface T on the front surface 226 of the magnet unit 220 is located radially inwards of the voice coil 230 relative to the longitudinal axis 203 of the loudspeaker 201, so that the flexible dustcap 240 is able to prevent dust from getting into the magnet unit 220 via the air gap 221.

Figure 6:
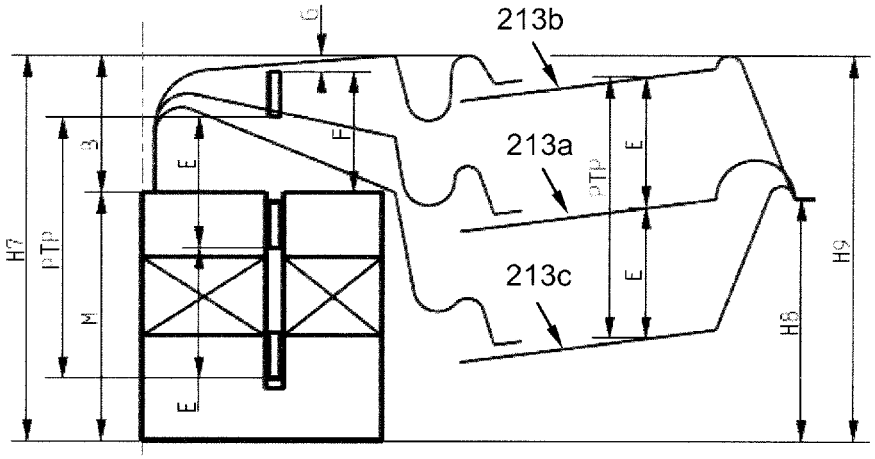
FIG. 6 shows the diaphragm 210 of the loudspeaker 201 of FIG. 5 in each of a nominal position, a maximum extent in a forward direction 214, and a maximum extent in a backward direction 218.

FIG. 6 shows the diaphragm 210 of the loudspeaker 201 of FIG. 5 in each of a nominal position as indicated by numeral 213*a* (this is a rest position, which is the position the diaphragm 210 is in when the voice coil 230 does not have a current passing through it), a maximum extent in the forward direction 214 as indicated by numeral 213*b* and a maximum extent in the backward direction 218 as indicated by numeral 213*c*. The positions of the dustcap 240, the voice coil 230, and the roll suspension 211 when the diaphragm is in each of the three positions are also shown in FIG. 6.

The following distances are also labelled in FIG. 6:

E: excursion distance, this being the distance in the direction of the longitudinal axis 203 between the nominal position (indicated by numeral 213*a*) and each of the maximum extent in the forward direction 214 (as indicated by numeral 213*b*) and the maximum extent in the backward direction 218 (as indicated by numeral 213*c*) of the diaphragm 210.

PTP: peak to peak excursion distance, this being the distance in the direction of the longitudinal axis 203 between the maximum extent in the forward direction 214 and the maximum extent in the backward direction 218 of the diaphragm 210 (this being twice the excursion distance E)

B: distance in the direction of the longitudinal axis 203 between the front surface 226 of the magnet unit 220 and a forward-most location on the flexible dustcap 240 when the diaphragm 210 is at its maximum extent in the forward direction 214

H7: distance in the direction of the longitudinal axis 203 between the forward-most location on the flexible dustcap 240 when the diaphragm 210 is at its maximum extent in the forward direction 214 and the rear surface 228 of the magnet unit 220

H8: distance in the direction of the longitudinal axis 203 between a point on the frame from which the diaphragm 210 is suspended and the rear surface 228 of the magnet unit 220

H9: distance in the direction of the longitudinal axis 203 between a forward-most location on the roll suspension 211 when the diaphragm 210 is at its maximum extent in the forward direction 214 and the rear surface 228 of the magnet unit 220

M: distance in the direction of the longitudinal axis 203 between the front surface 226 and the rear surface 228 of the magnet unit 220

F: distance in the direction of the longitudinal axis 203 between the front surface 226 of the magnet unit 220 and a forward-most location on the voice coil 230 when the diaphragm 210 is at its maximum extent in the forward direction 214

G: distance in the direction of the longitudinal axis 203 between a forward-most location on the voice coil 230 when the diaphragm 210 is at its maximum extent in the forward direction 214 and a forward-most location on the flexible dustcap 240 when the diaphragm 210 is at its maximum extent in the forward direction 214

As shown, the flexible dustcap 240 is configured to allow the diaphragm 210 to be moved from a nominal position up to a maximum extent in the forward direction 214 and a maximum extent in the backward direction 218 without the flexible dustcap contacting the magnet unit 220 or the voice coil 230 in use.

Because of its shape, the height B of a forward-most location on the flexible dustcap 240 above the front surface of the magnet unit 220 when the diaphragm 210 is at its maximum extent in the forward direction 214, is able to be closer to the excursion E, compared with the flexible dustcap 140 of FIG. 3.

As shown, the flexible dustcap extends in the direction of the longitudinal axis 203 by a distance G above the forward-most location on the voice coil 230 when the diaphragm 210 is at its maximum extent in the forward direction. G is preferably 20 mm or less, more preferably 10 mm or less, more preferably 8 mm or less, 5 mm or less, more preferably 4 mm or less, more preferably 3 mm or less, more preferably 2 mm or less, more preferably 1 mm or less and may in practice be ~3 mm.

In effect, the flexible dustcap 240 of the loudspeaker 201 FIG. 5 allows the loudspeaker 201 to have a height (when the diaphragm is at its maximum extent in the forward direction) that is limited to the position of the voice coil 230 plus the thickness of the flexible dustcap 230 at the voice coil, plus a small clearance.

It may be challenging, though not impossible, to have G substantially below ~5 mm because in practice, a clearance e.g. of ~1 mm between the voice coil 230 and the dustcap 240 may be required when the diaphragm 210 is at its maximum extent in the forward direction, the dustcap 240 may have a thickness of ~2 mm in this region, and there could also be a contribution to G of 1-2 mm from the upward slope of an outwardly extending portion 242 of the flexible dustcap 240 when the diaphragm 210 is at its maximum extent in the forward direction.

Figure 7:
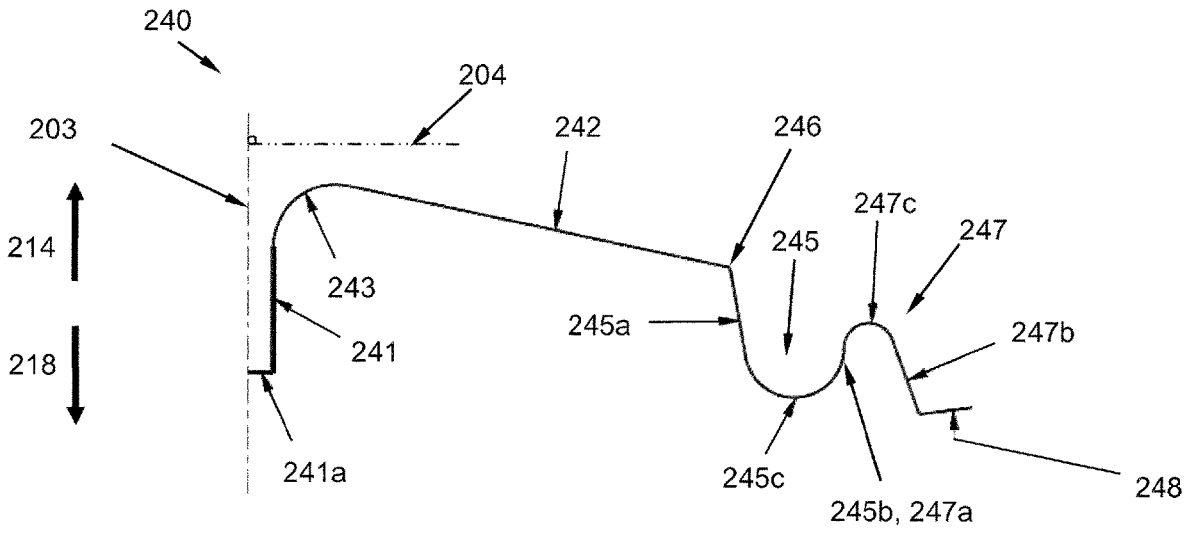
FIG. 7 shows the flexible dustcap 240 of the loudspeaker 201 of FIG. 5 in more detail.

The flexible dustcap 240 of the loudspeaker 201 of FIG. 5 is shown in more detail in FIG. 7. Various features and properties of the flexible dustcap 240 will now be described with reference to when the diaphragm 210 is in its nominal position (since other positions of the diaphragm 210 may cause the flexible dustcap 240 to deform).

As shown in FIG. 7, the flexible dustcap 240 may include an upstanding portion 241 which extends around the longitudinal axis 203 of the loudspeaker 201 and which, when viewed in a cross-section taken along the longitudinal axis 203 of the loudspeaker 201 (as represented in FIG. 7), extends in the forwards direction 214 from the attachment surface on the front surface 226 of the magnet unit 220, preferably at an angle that is no more than 30° with respect to the longitudinal axis 203 of the loudspeaker 201, though larger angles may be possible if the upstanding portion 241 is adequately stiff. The upstanding portion 241 may attach to the attachment surface directly, or via an (optional) inner attachment portion 241*a* of the flexible dustcap 240. The upstanding portion 241 may help to create a distance (in the direction of the longitudinal axis 203) between the front surface 226 of the magnet system 20 and the start of an outwardly extending portion 242 of the flexible dustcap 240 (described below). To achieve this function, the upstanding portion 241 may be stiffer than other regions of the flexible dustcap 240. Such stiffness may be achieved by the outwardly extending portion 242 having a thickness that is larger than some other regions of the flexible diaphragm 240, or by adding additional stiffening material in this region of the flexible dustcap 240.

Although in this example, the attachment surface T is on the front surface 226 of the magnet unit 220, the attachment surface T could be located on other elements of the loudspeaker (e.g. the frame of the loudspeaker) though the attachment surface T is preferably fixed with respect to the magnet unit 220.

The flexible dustcap 240 may include an outwardly extending portion 242 which extends around the longitudinal axis 203 of the loudspeaker 201 and which, when viewed in a cross-section taken along the longitudinal axis 203 of the loudspeaker 201 (as represented in FIG. 7), extends radially outwards from the upstanding portion 241 relative to the longitudinal axis 203 of the loudspeaker 201. The outwardly extending portion may, when viewed in a cross-section taken along the longitudinal axis 203 of the loudspeaker 201, form an angle that is no more than 20° with respect to a radial axis 204 that extends radially outwardly from and is perpendicular to the longitudinal axis 203 of the loudspeaker 201. The outwardly extending portion 242 is preferably adequately stiff and resists bending in use in order to create space for the voice coil 230 when the diaphragm 210 is at its maximum extent in the forward direction 214. Such stiffness may be achieved by the outwardly extending portion 242 having a thickness that is larger than some other regions of the flexible diaphragm 210, or by adding additional stiffening material in this region of the flexible dustcap 240.

The upstanding portion 241 may be joined to the outwardly extending portion 242 by a bend 243 in the flexible dustcap 240, wherein the bend 243 extends around the longitudinal axis 203 of the loudspeaker 201. The bend 243, when viewed in a cross-section taken along the longitudinal axis 203 of the loudspeaker 201 (as represented in FIG. 7), preferably has a smoothly changing curvature, rather than being a sharp fold or corner in the flexible dustcap 240. The bend 243 may allow the outwardly extending portion 242 to move forwards and backwards with movement of the diaphragm 210.

The flexible dustcap 240 may include a first corrugation 245 which extends around the longitudinal axis 203 of the loudspeaker 201. The first corrugation 245, when viewed in a cross-section taken along the longitudinal axis 203 of the loudspeaker 201 (as represented in FIG. 7), may form a ridge or furrow in the flexible dustcap (the first corrugation 245 as oriented in FIG. 7 may be viewed as forming a furrow). The first corrugation 245 may, when viewed in a cross-section taken along the longitudinal axis 203 of the loudspeaker, include two arms 245*a*, 245*b* which join at a base 245*c*, e.g. to form a "U" shape or a "V" shape (preferably a "U" shape as shown in FIG. 7). Preferably the first corrugation 245 is oriented with its base 245*c* facing in the backward direction 218 (as shown in FIG. 7). One arm (preferably the radially innermost arm 245*a*) of the first corrugation 245 may be joined to the outwardly extending portion 242, preferably via a non-smoothly changing fold 246 (e.g. a sharp fold or corner) in the flexible dustcap 240. In some examples, the radially innermost arm 245*a* of the first corrugation 245 may form an angle that is no more than 20° with respect to the longitudinal axis 203 of the loudspeaker 201. The radially innermost arm 245*a* of the first corrugation 245 may allow the flexible dustcap 240 to get closer to the diaphragm 210 and may be configured to roll off when the diaphragm 210 is at maximum excursion in the backward direction 218, as shown e.g. in FIG. 6.

The flexible dustcap 240 may include a second corrugation 247 which extends around the longitudinal axis 203 of the loudspeaker 201. The second corrugation 247, when viewed in a cross-section taken along the longitudinal axis 203 of the loudspeaker 201, may form a ridge or furrow in the flexible dustcap 240 (the second corrugation 247 as oriented in FIG. 7 may be viewed as forming a ridge). The second corrugation 247 may, when viewed in a cross-section taken along the longitudinal axis 203 of the loudspeaker 201, include two arms 247*a*, 247*b* which join at a base 247*c*, e.g. to form a "U" shape or a "V" shape (preferably a "U" shape as shown in FIG. 7). Preferably the second corrugation 247 is oriented with its base 247*c* facing in the forward direction 214 (as shown in FIG. 7). One arm (preferably the radially innermost arm 247*a*) of the second corrugation 247 may also be the radially outermost arm 245*b* of the first corrugation 245. One arm (preferably the radially outermost arm 247*b*) of the second corrugation 247 may attach to the front surface 212 or back surface 216 of the diaphragm 210, e.g. directly, or via an (optional) outer attachment portion 248 of the flexible dustcap 240. In some examples, the radially outermost arm 247*b* of the second corrugation 247 may form an angle that is no more than 20° with respect to the longitudinal axis 203 of the loudspeaker 201. The radially outermost arm 247*b* of the second corrugation 247 may be configured to roll off when the diaphragm is at maximum excursion in the forward direction, as shown e.g. in FIG. 6.

The first and second corrugations 245, 247 are preferably configured to bend in the forward and backward directions during movement of the diaphragm 210 in the forward and backward directions.

The flexible dustcap 240 may be a single piece of rubber.

Although not shown in the figures, the upstanding portion 341 may be slightly thicker than the bend 343, which is in turn may be slightly thicker than the outwardly extending portion 342, with the thickness of the outwardly extending portion 342 optionally being thicker than the first and second corrugations 345, 347 (which may e.g. have the same thickness as each other). These relative thicknesses may help the different portions of the flexible dustcap 340 to have different stiffnesses so that the portions function as described above.

It is noted for completeness that the upstanding portion 241, the bend 243, the outwardly extending portion 242 and the radially innermost arm 245*a* of the first corrugation 245 can together be seen as forming a further (third) corrugation (which, as oriented in FIG. 7 may be viewed as forming a ridge) in the flexible dustcap 240.

Figure 8:
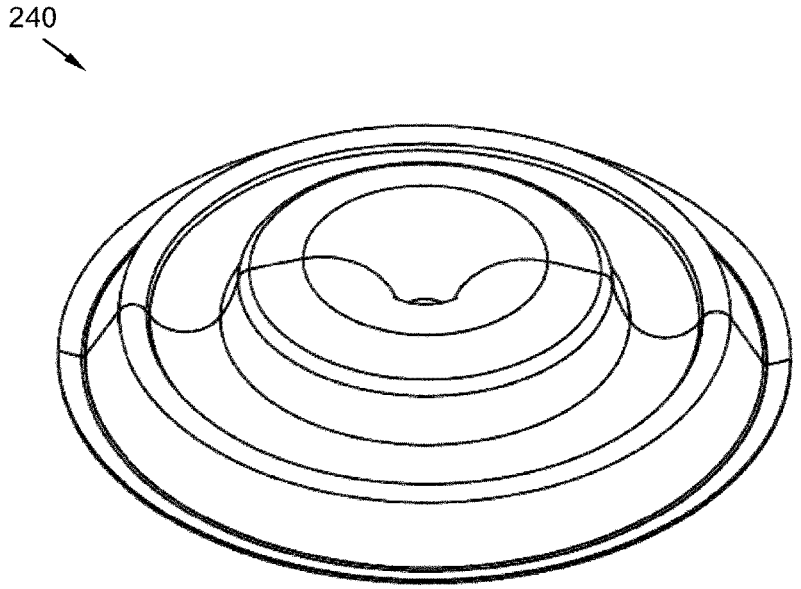
FIG. 8 is a perspective view of the flexible dustcap 240 of the loudspeaker 201 of FIG. 5, with a line drawn over the flexible dustcap to illustrate its profile.

FIG. 8 is a perspective view of the flexible dustcap 240 of the loudspeaker 201 of FIG. 5, with a line drawn over the flexible dustcap to illustrate its profile.

FIG. 9 provides a comparison between the heights A, D, B of the dustcaps of the loudspeakers 1, 101, 201 of FIGS. 1, 3 and 5 above the front surface of the magnet unit when the diaphragm is at its maximum extent in the forward direction.

FIG. 9 demonstrates that the flexible dustcap 240 of the loudspeaker 201 of FIG. 5 is capable of significantly reducing the height of a loudspeaker when the diaphragm is at its maximum extent in the forward direction compared with the other designs, particularly where the diaphragm has a relatively flat shape as shown in FIG. 9.

Figure 10:
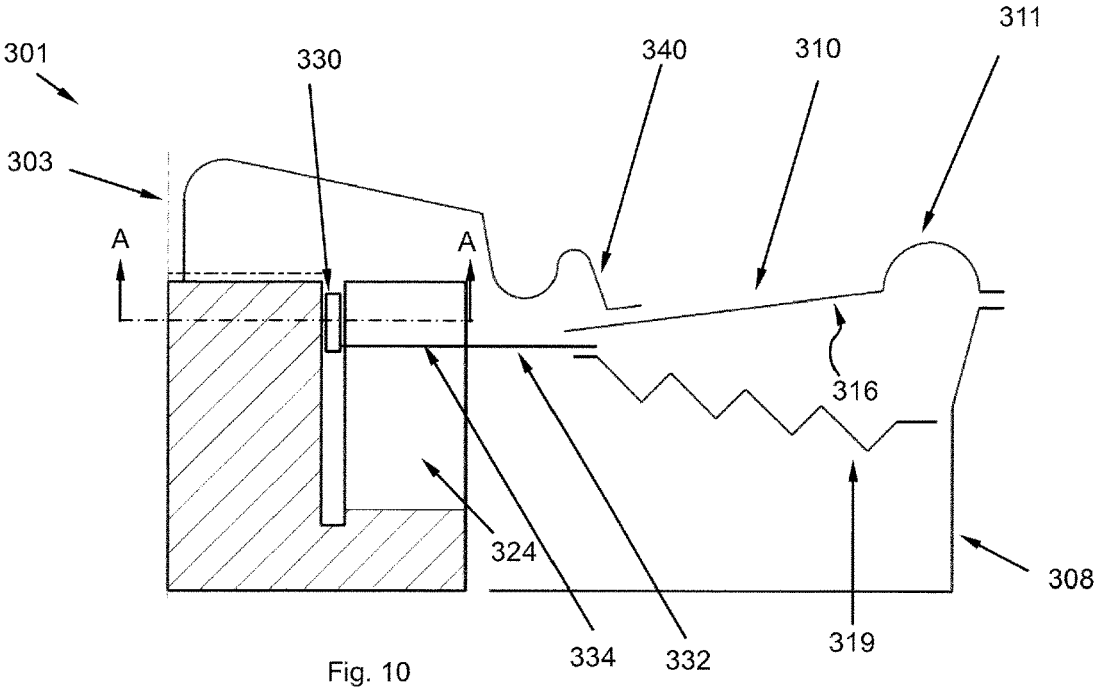
FIGS. 10-11 illustrate an example loudspeaker 301 which includes a flexible dustcap 340 and which represents an example implementation of the loudspeaker 201 of FIG. 5.
Figure 11:
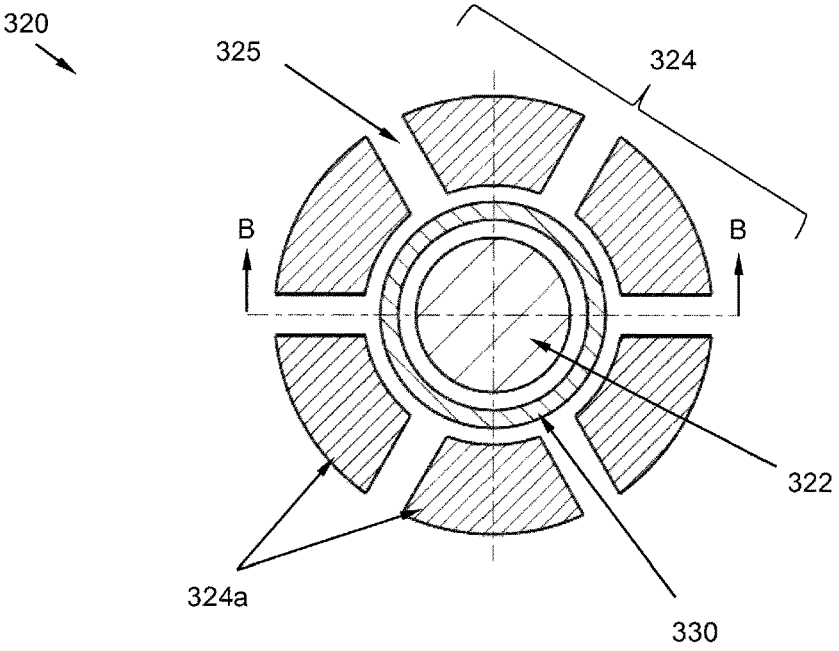

FIGS. 10-11 illustrate an example loudspeaker 301 which includes a flexible dustcap 340 and which represents an example implementation of the loudspeaker 201 of FIG. 5.

The loudspeaker 301 of FIG. 10 is similar to the loudspeaker 201 of FIG. 5 in several respects, and alike components have been given corresponding reference numerals and need not be explained in further detail, except where an alternative explanation is provided below.

FIG. 10 is a cross-section of the loudspeaker 301 taken along a plane illustrated by the line B-B shown in FIG. 11. FIG. 11 is a cross section of the loudspeaker 301 taken along a plane illustrated by the line A-A in FIG. 10.

FIG. 11 clearly show the slits in the magnetic field guiding element 324 of the magnet unit 320. In this case, the slits extend entirely through the magnetic field guiding element 324, such that the magnetic field guiding element 324 is formed of multiple bodies 324*a*. It may therefore be noted that it is easier to form slits in a magnetic field guiding element 324 than it would be in a permanent magnet (particularly where the slits extend entirely through the permanent magnet, which would in effect require multiple permanent magnets), hence it may be preferred for the permanent magnet to be located radially inwards (relative to the longitudinal axis 303) of the voice coil 330, rather than radially outwards of the voice coil 330.

In the example loudspeaker 301 illustrated in FIG. 10, a frame 308 of the loudspeaker is made of metal.

FIG. 10 shows the rigid connector 332 which rigidly connects the voice coil 330 to the diaphragm 310 via ribs 334 which extend through slits 325 in the magnetic field guiding element 324. In this example, there are six such ribs 334, though of course other numbers are possible. In this example, the rigid connector 332 is glued to the voice coil 330 (there is no voice coil former in this example) and glued to the back surface 316 of the diaphragm 310.

The cross section of FIG. 10 is taken through one of the slits 325 in the magnetic field guiding element 324 in order to illustrate the connection between the rigid connector 332, the diaphragm 310 and the voice coil 330.

FIG. 10 also shows that the loudspeaker 301 includes a spider 319 which connects to the diaphragm (by being glued to the rigid connector 332) and is also attached, e.g by glue, to the frame 308.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

The invention claimed is:

1. A loudspeaker including:

a diaphragm having a front surface facing in a forward direction for producing sound to be radiated outwardly from the loudspeaker in the forward direction and a back surface facing in a backward direction that is opposite to the forward direction;

a magnet unit configured to provide magnetic field in a predetermined region of space;

a voice coil rigidly connected to the diaphragm, wherein the voice coil is configured to produce a magnetic field in use which interacts with the magnetic field provided by the magnet unit in the predetermined region of space so as to move the diaphragm along a longitudinal axis of the loudspeaker;

a flexible dustcap attached to the diaphragm and an attachment surface of the loudspeaker that is fixed with respect to the magnet unit and is located radially inwards of the voice coil relative to the longitudinal axis of the loudspeaker, wherein the voice coil is rigidly connected to the diaphragm via a rigid connector, wherein the rigid connector includes ribs which extend through slits in a component located radially outwards of the voice coil, wherein the component that includes the slits is one of the two components of the magnet unit between which an air gap is located, wherein the air gap is the predetermined region of space.

2. A loudspeaker according to claim 1, wherein the flexible dustcap includes more than one corrugation.

3. A loudspeaker according to claim 1, wherein the flexible dustcap is configured to allow the diaphragm to be moved along the longitudinal axis from a nominal position up to a maximum extent in the forward direction and a maximum extent in the backward direction without the flexible dustcap contacting the magnet unit or the voice coil in use.

4. A loudspeaker according to claim 1, wherein the loudspeaker has a height in the direction of the longitudinal axis of the loudspeaker from a forward-most surface to a backward-most surface of the loudspeaker when the diaphragm is at its maximum extent in the forward direction of 75 mm or less, wherein the distance in the direction of the longitudinal axis between the maximum extent in the forward direction and the maximum extent in the backward direction of the diaphragm is 30 mm or more.

5. A loudspeaker according to claim 1, wherein the attachment surface is a surface of the magnet unit, or a surface on a frame of the loudspeaker that is fixed with respect to the magnet unit.

6. A loudspeaker according to claim 1, wherein the flexible dustcap includes an upstanding portion which extends around the longitudinal axis of the loudspeaker and which, when viewed in a cross-section taken along the longitudinal axis of the loudspeaker, extends in the forwards direction from the attachment surface of the loudspeaker.

7. A loudspeaker according to claim 6, wherein the upstanding portion, when viewed in a cross-section taken along the longitudinal axis of the loudspeaker, extends in the forwards direction from the attachment surface of the loudspeaker at an angle that is no more than 30° with respect to the longitudinal axis of the loudspeaker.

8. A loudspeaker according to claim 1, wherein the flexible dustcap includes an outwardly extending portion which extends around the longitudinal axis of the loudspeaker and which, when viewed in a cross-section taken along the longitudinal axis of the loudspeaker, extends radially outwards from the upstanding portion relative to the longitudinal axis of the loudspeaker.

9. A loudspeaker according to claim 8, wherein the outwardly extending portion, when viewed in a cross-section taken along the longitudinal axis of the loudspeaker, forms an angle that is no more than 20° with respect to a radial axis that extends radially outwardly from and is perpendicular to the longitudinal axis of the loudspeaker.

10. A loudspeaker according to claim 1, wherein the flexible dustcap includes a first corrugation which extends around the longitudinal axis of the loudspeaker.

11. A loudspeaker according to claim 10, wherein the first corrugation, when viewed in a cross-section taken along the longitudinal axis of the loudspeaker, includes two arms which join at a base, wherein the first corrugation is oriented with its base facing in the backward direction.

12. A loudspeaker according to claim 10, wherein the flexible dustcap includes a second corrugation which extends around the longitudinal axis of the loudspeaker.

13. A loudspeaker according to claim 12, wherein the second corrugation, when viewed in a cross-section taken along the longitudinal axis of the loudspeaker, includes two arms which join at a base, wherein the second corrugation is oriented with its base facing in the forward direction.

14. A loudspeaker according to claim 12, wherein the radially innermost arm of the second corrugation is also a radially outermost arm of the first corrugation, and the radially outermost arm of the second corrugation attaches to the diaphragm.

15. A loudspeaker according to claim 1, wherein the flexible dustcap extends in the direction of the longitudinal axis by a distance G above a forward-most location on the voice coil when the diaphragm is at its maximum extent in the forward direction, wherein G is 10 mm or less.

16. A loudspeaker according to claim 1, wherein the flexible dustcap is a single piece of flexible material, e.g. rubber or textile (with or without coating), wherein the thicknesses of different portions of the flexible dustcap are different to each other.

17. A loudspeaker according to claim 1, wherein the materials of different portions of the flexible dustcap are different to each other.

18. A loudspeaker according to claim 1, wherein the loudspeaker is a subwoofer.

19. A loudspeaker including:

a diaphragm having a front surface facing in a forward direction for producing sound to be radiated outwardly from the loudspeaker in the forward direction and a back surface facing in a backward direction that is opposite to the forward direction;

a magnet unit configured to provide magnetic field in a predetermined region of space;

a voice coil rigidly connected to the diaphragm, wherein the voice coil is configured to produce a magnetic field in use which interacts with the magnetic field provided by the magnet unit in the predetermined region of space so as to move the diaphragm along a longitudinal axis of the loudspeaker;

a flexible dustcap attached to the diaphragm and an attachment surface of the loudspeaker that is fixed with respect to the magnet unit and is located radially inwards of the voice coil relative to the longitudinal axis of the loudspeaker, wherein the flexible dustcap includes a first corrugation which extends around the longitudinal axis of the loudspeaker, wherein the flexible dustcap includes a second corrugation which extends around the longitudinal axis of the loudspeaker, wherein the second corrugation, when viewed in a cross-section taken along the longitudinal axis of the loudspeaker, includes two arms which join at a base, wherein the second corrugation is oriented with its base facing in the forward direction.

20. A loudspeaker including:

a diaphragm having a front surface facing in a forward direction for producing sound to be radiated outwardly from the loudspeaker in the forward direction and a back surface facing in a backward direction that is opposite to the forward direction;

a magnet unit configured to provide magnetic field in a predetermined region of space;

a voice coil rigidly connected to the diaphragm, wherein the voice coil is configured to produce a magnetic field in use which interacts with the magnetic field provided by the magnet unit in the predetermined region of space so as to move the diaphragm along a longitudinal axis of the loudspeaker;

a flexible dustcap attached to the diaphragm and an attachment surface of the loudspeaker that is fixed with respect to the magnet unit and is located radially inwards of the voice coil relative to the longitudinal axis of the loudspeaker, wherein the flexible dustcap includes a first corrugation which extends around the longitudinal axis of the loudspeaker, wherein the flexible dustcap includes a second corrugation which extends around the longitudinal axis of the loudspeaker, wherein the radially innermost arm of the second corrugation is also a radially outermost arm of the first corrugation, and the radially outermost arm of the second corrugation attaches to the diaphragm.

* * * * *